US009074459B2

(12) United States Patent
Mitchell et al.

(10) Patent No.: US 9,074,459 B2
(45) Date of Patent: Jul. 7, 2015

(54) SYSTEM AND METHOD FOR SIMULATION OF DOWNHOLE CONDITIONS IN A WELL SYSTEM

(75) Inventors: Robert Mitchell, Houston, TX (US); Adolfo C. Gonzales, Houston, TX (US); Yongfeng Kang, Katy, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 340 days.

(21) Appl. No.: 13/567,711

(22) Filed: Aug. 6, 2012

(65) Prior Publication Data

US 2014/0034390 A1 Feb. 6, 2014

(51) Int. Cl.

| | |
|---|---|
| ***G06G 7/48*** | (2006.01) |
| ***E21B 47/06*** | (2012.01) |
| ***G06G 7/56*** | (2006.01) |

(52) U.S. Cl.

CPC ..... *E21B 47/065* (2013.01); *G06G 7/56* (2013.01)

(58) Field of Classification Search

CPC ..... E21B 29/08; E21B 36/04; E21B 43/16; E21B 43/24; E21B 7/00; E21B 47/00; E21B 43/00; E21B 36/00; E21B 7/04; E21B 49/00; E21B 23/00; E21B 43/25; E21B 43/30; F01K 15/00; G06D 7/06; G06F 17/00; G06F 19/00; G06G 7/48; G06G 7/50; G06G 7/57; G06G 7/66; H05B 3/02; H05B 1/02

USPC ..... 703/6, 10; 166/302, 250.01, 265, 166/250.15; 702/12, 11; 73/152.55

See application file for complete search history.

(56) References Cited

U.S. PATENT DOCUMENTS

| | | | | |
|---|---|---|---|---|
| 8,682,589 | B2 * | 3/2014 | Thigpen et al. | 702/12 |
| 2007/0234789 | A1 * | 10/2007 | Glasbergen et al. | 73/152.55 |
| 2007/0272406 | A1 * | 11/2007 | McCoy et al. | 166/250.01 |
| 2010/0198533 | A1 * | 8/2010 | Peacock et al. | 702/47 |
| 2011/0071810 | A1 * | 3/2011 | Yeriazarian et al. | 703/10 |
| 2012/0073804 | A1 * | 3/2012 | Harman et al. | 166/250.01 |
| 2012/0193099 | A1 * | 8/2012 | Vinegar et al. | 166/302 |
| 2013/0035920 | A1 * | 2/2013 | Al-Shammari | 703/10 |
| 2013/0068454 | A1 * | 3/2013 | Armistead | 166/265 |
| 2013/0175030 | A1 * | 7/2013 | Ige et al. | 166/250.15 |
| 2014/0039797 | A1 * | 2/2014 | Gonzales et al. | 702/11 |

OTHER PUBLICATIONS

O'Bryan et al., "Validation and optimization of heat transfer in the electrical submersible pump motor by CFD", ASME 2011 International Mechanical Engineering Congress, Nov. 2011.*

Chen et al., "Review of Electrical Machine in Downhole Applications and the Advantages", IEEE, 2008.*

Liang et al., "Power consumption evaluation for electrical submersible pump systems" IEEE 2012.*

(Continued)

*Primary Examiner* — Kandasamy Thangavelu

(57) ABSTRACT

A method for simulating downhole conditions is described. The method includes receiving configuration information about a well system in a production configuration, the well system including annular fluids disposed therein and receiving heat source information associated with a heat source disposed within the well system. The method also includes simulating temperature transfer in the well system during a production scenario based at least on the configuration information and the heat source information and predicting pressure buildup in the annular fluids based on the simulated temperature transfer in the well system.

28 Claims, 4 Drawing Sheets

(56) References Cited

OTHER PUBLICATIONS

Rodriguez et al., "Parametric Study of Motor/Shroud Heat Transfer Performance in an Electrical Submersible Pump (ESP)", ASME, Sep. 2000.*
"Submersible Pump," Wikipedia, Aug. 7, 2013; http://en.wikipedia.org/wiki/submersible_pump.
"Artificial Lift," Schlumberger, Aug. 7, 2013; http://www.slb.com/services/production/artificial_lift.aspx?submersible.aspx.
Halal et al., Casing Design for Trapped Annular Pressure Buildup, (Abstract, p. 1, right column, paragraphs 1-4, p. 6, left col. second to last paragraph to right column, last paragraph, p. 7, left column, paragraphs 2-4) Jun. 1994, vol. 9, No. 2 pp. 107-114, SPE Drilling and Completion.
Examiner Lee W. Young, PCT Notification of Transmittal of the International Search Report and the Written Opinion of the International Searching Authority, or the Declaration, Dec. 9, 2013, 9 pages, International Searching Authority, Alexandria, Virginia.

* cited by examiner

SYSTEM AND METHOD FOR SIMULATION OF DOWNHOLE CONDITIONS IN A WELL SYSTEM

BACKGROUND

Wellbore and downhole simulation is an area of oil and gas engineering that employs computer models to predict the state of wellbore components above and below the surface of a formation. Downhole simulators can be used by petroleum producers to determine how best to design new wells, including casing and tubing design, as well as to generate models of wellbore movement within a formation and stresses on wellbore components during production.

In oil and gas wellbore simulation, it is desirable to simulate pressure buildup and the effects of such pressure buildup in annular fluid disposed between casing and tubing strings in a multi-string well systems. Heretofore, conventional downhole simulators do not account for thermal transfer between certain components in simulation of a proposed wellbore system. Thus, although existing approaches to downhole simulation have been satisfactory for their intended purposes, they have not been entirely satisfactory in all respects.

BRIEF DESCRIPTION OF THE DRAWINGS

A more complete understanding of the present disclosure and advantages thereof may be acquired by referring to the following description taken in conjunction with the accompanying figures, wherein.

DETAILED DESCRIPTION

Illustrative embodiments and related methodologies of the present invention are described below as they might be employed in a system for simulating downhole conditions. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the present disclosure will become apparent from consideration of the following description and drawings.

To overcome the above-noted and other limitations of the current approaches, embodiments described herein comprise methods and systems for simulation of downhole conditions in a well system.

Figure 1:
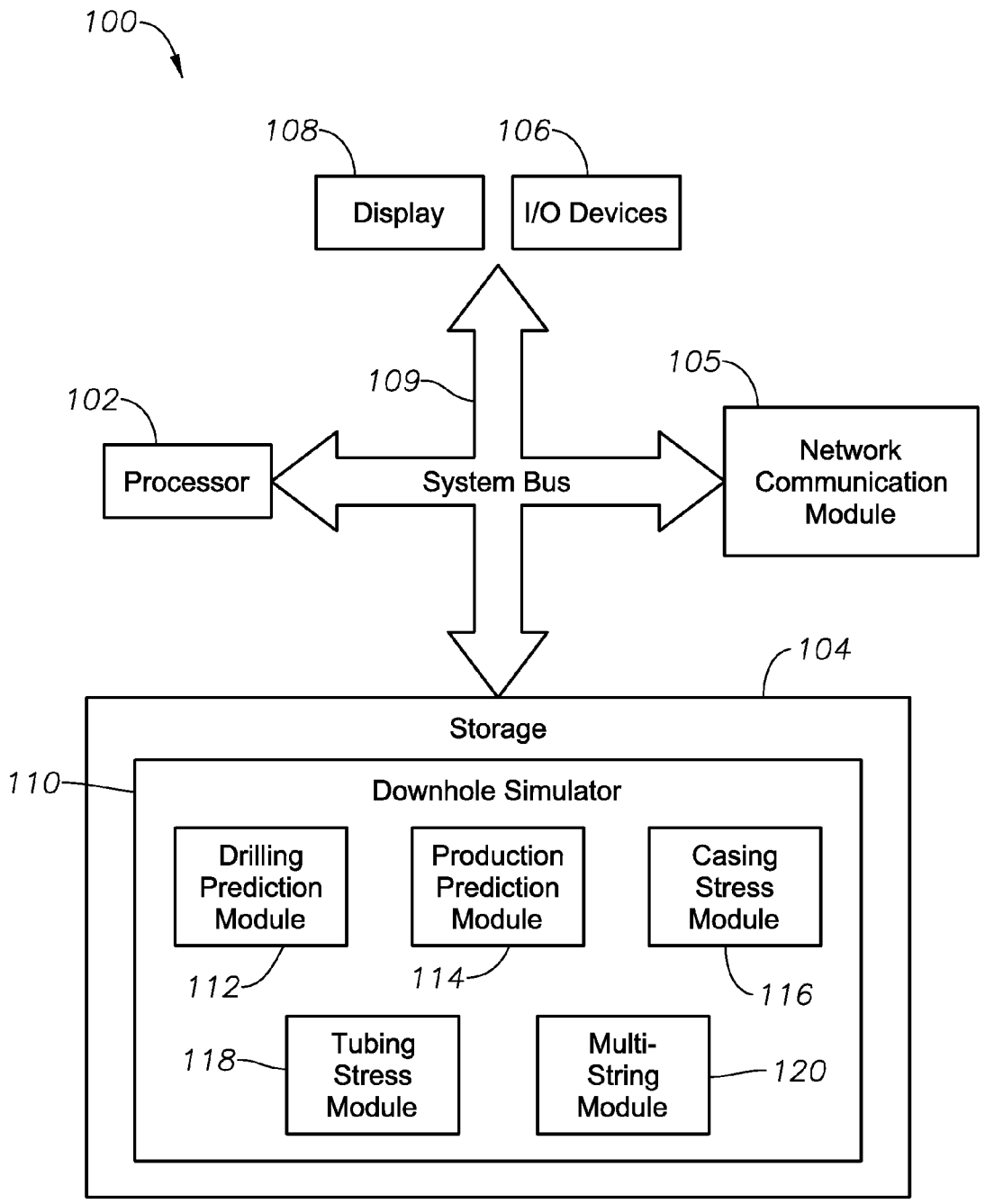
FIG. 1 is a block diagram of a downhole simulation system according to various aspects of the present disclosure.

FIG. 1 is a block diagram of a downhole simulation system 100 according to various aspects of the present disclosure. In one embodiment, the downhole simulation system 100 includes at least one processor 102, a non-transitory, computer-readable storage 104, an optional network communication module 105, optional I/O devices 106, and an optional display 108, all interconnected via a system bus 109. The network communication module 105 may be operable to communicatively couple the downhole simulation system 100 to other devices over a network. In one embodiment, the network communication module 105 is a network interface card (NIC) and communicates using the Ethernet protocol. In other embodiment, the network communication module 105 may be another type of communication interface such as a fiber optic interface and may communicate using a number of different communication protocols. It is recognized that the downhole simulation system 100 may be connected to one or more public (e.g., the Internet) and/or private networks (not shown) via the network communication module 105. Such networks may include, for example, servers upon which wellbore and downhole data is stored. Software instructions executable by the processor 102 for implementing a downhole simulator 110 in accordance with the embodiments described herein may be stored in storage 104. It will also be recognized that the software instructions comprising the downhole simulator 110 may be loaded into storage 104 from a CD-ROM or other appropriate storage media.

As will be described below, the downhole simulator 110 is configured to simulate, model, or predict, conditions within a well system during various stages of its life cycle. For instance, temperatures and pressures within the well system, including all of its components, may be simulated during both drilling operations and production operations. Such a wellbore analysis may predict conditions such as casing and tubing movement, wellhead movement, pressure buildup in annular fluids within a well system, and the effects of these conditions on the system as a whole. For example, these predicted conditions may be evaluated to determine the integrity of well tubulars currently in a well system or utilized to select appropriate well tubulars or casings in a future well system. One of ordinary skill in the art would recognize that the above simulation objectives are simply examples and additional and/or different downhole conditions may be simulated by the downhole simulator 110. Further, the downhole simulation system 100 including the downhole simulator 110 may be employed to simulate downhole conditions in a variety of well system types, such as terrestrial-based well systems and sea-based well systems including high-pressure and high-temperature deepwater or heavy oil drilling systems.

As shown in the illustrated embodiment, the downhole simulator 110 includes a drilling prediction module 112, a production prediction module 114, a casing stress module 116, a tubing stress module 118, and a multi-string module 120. Based upon the input variables as described below, algorithms executed by the various modules function to formulate the downhole conditions analysis workflow of the present invention. Drilling prediction module 112 simulates, or models, drilling events and the associated well characteristics such as the drilling temperature and pressure conditions present downhole during logging, trip pipe, casing, and cementing operations. Production prediction module 114 models production events and the associated well characteristics such as the fluid, heat, and pressure transfer within the well system during circulation, production, well servicing, and injection operations. Casing stress module 116 models the stresses caused by changes from the initial to final temperatures and/or loads on the casing, as well as the temperature and pressure conditions affecting the casing. Such stress models may predict design integrity and buckling behavior of the casings within the well system. Tubing stress module 118 simulates the stresses caused by changes from the initial to final temperatures and/or loads on the tubing, as well as the temperature and pressure conditions affecting the tubing. As an aspect of this, the tubing stress module 118 may predict tubing loads and movements, buckling behavior and design integrity of tubing in a well system under production scenarios. The modeled data received from the foregoing modules 112, 114, 116, and 118 is fed into multi-string module 120 which performs a total well system analysis (i.e., all "strings" in the well system are modeled together). In particular, the multi-string module 120 is configured to analyze the influence of the thermal expansion of annular fluids within the well system (which thermal expansion can result in annular pressure buildup or trapped annular pressure), and/or the influence of loads imparted on the wellhead during the life of the well, on the integrity of a well's tubulars. In other words, the multi-string module 120 determines the effects of the expansion of annular fluids, and the position (displacement) of the wellhead as a result of production operations and/or the injection of hot/cold fluids into the well. These pressure loads and wellhead displacement values are used to determine the integrity of a well's tubulars. Persons of ordinary skill in the art having the benefit of this disclosure will realize that in alternative embodiments the downhole simulator 110 may include different and/or additional modules configured to simulate different aspects of a well system and that there are a variety modeling algorithms that may be employed to achieve the results of the present invention. For example, not all of the above-described modules need be utilized. Likewise, while the invention is described primarily as modeling a wellbore system under production scenarios, the invention can also be used to model a wellbore system under drilling scenarios. Additionally, in certain embodiments, the downhole simulator 110 may be a specialized hardware component of the downhole simulation system 100 or may be a hybrid system comprised of both hardware and software.

To simulate downhole conditions in a well system, engineers may first input into the downhole simulator 110 a variety of configuration data and operation variables that are associated with and represent a well system. The simulated downhole conditions produced by the simulator 110 are specific to the particular well system described by the configuration information input into the simulator. As one of ordinary skill in the art would realize with the benefit of this disclosure is that the more accurate the configuration data describing a well system is, the more accurate the simulated downhole conditions will be. Thus, to accurately simulate thermal transfer during production scenarios, the production module 114 needs not only configuration information describing standard well system components, but also information describing any heat sources disposed within the well system. An electrical submersible pump (ESP) is one example of a heat source that may affect thermal conditions within a well system during production. In some well systems, an ESP may be incorporated into a well completion configuration to improve production rates. Of course, one of ordinary skill in the art would recognize that many other sources of heat may be present in a well system and, thus, should be accounted for in a thermal flow simulation. For example, a well system may include rotary steerable systems (downhole motor during drilling phase) and downhole electric heaters (heavy oil production enhancement scenarios). In some scenarios, a well system may include devices to lower temperatures in the well system such as mud coolers that reduce drilling and/or mud fluid temperatures. Certain embodiments of the present disclosure, as described in more detail below, provide for a method and system for downhole simulation that accounts for heat sources within a well system such as one or more electrical submersible pumps. In this manner, downhole simulations may more effectively predict conditions in a well system during production or injection operations. The downhole simulator 110 in the downhole simulation system 100 may implement this method and other methods contemplated by the embodiment.

Figure 2:
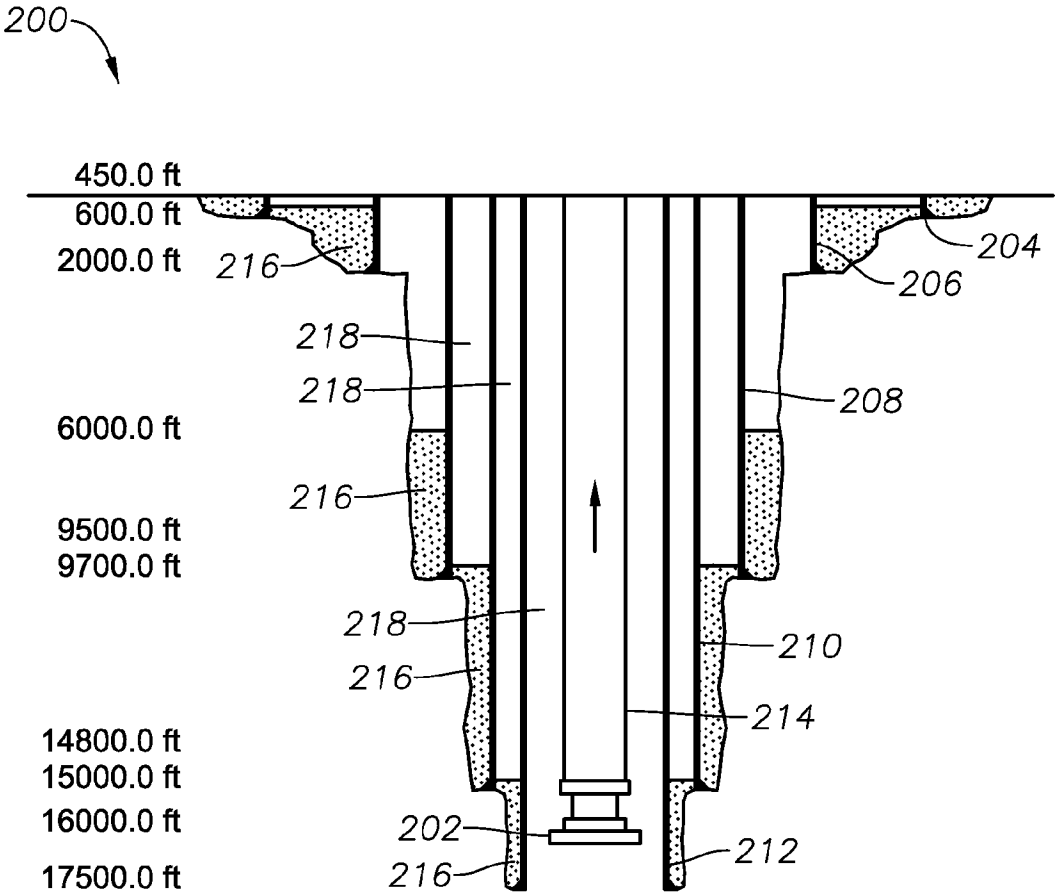
FIG. 2 is a diagrammatic cross-section of a well system that includes an electrical submersible pump.

FIG. 2 is a diagrammatic cross-section of a well system 200 that includes an electrical submersible pump 202. The well system 200 is shown in a completion (i.e., production) configuration and includes a plurality of tubular components or "strings." The well system 200 in the example embodiment of FIG. 2 includes a first conductor driven casing 204, a second surface casing 206, a third intermediate casing 208, and a fourth protective casing 210 below RKB. The well system also includes a production liner 212 and a production tubing 214 disposed within the first production liner. While not intended as a limitation, but for illustrative purposes only, first conductor driven casing 204 has a 30 inch diameter and extends approximately 600 ft measured depth below rig kelly bushing (RKB), second surface casing 206 has a 20 inch diameter and extends approximately 2,000 ft measured depth below RKB, third intermediate casing 208 has a 13⅜ inch diameter and extends approximately 9,700 ft measured depth below RKB, and fourth protective casing 210 has a 9⅝ inch diameter and extends approximately 15,000 ft measured depth below RKB. Production liner 212 has a 7 inch diameter and extends approximately 17,500 ft measured depth below RKB and production tubing 214 has a 3½ inch diameter. In this example, depths are measured relative to the rig kelly bushing datum above mean sea level. In any even, concrete 216 is disposed between each concentric casing to strengthen the well bore and prevent leakage. Additionally, annular fluids 218 are present between the concentric strings of the well system and are subjected to various pressure and thermal changes while the well system is in a production mode. As the pressure of the annular fluids 218 increases with temperature increases, the tubular components of the well system 200 are subjected to stresses which can cause expansion and/or buckling. The ESP 202 is coupled to the end of the production tubing 214 and is configured to more efficiently draw hydrocarbons or other fluids from a reservoir into the production tubing 214. In one illustrative example, ESP may be positioned approximately 15,000 ft measured depth below RKB.

Figure 3:
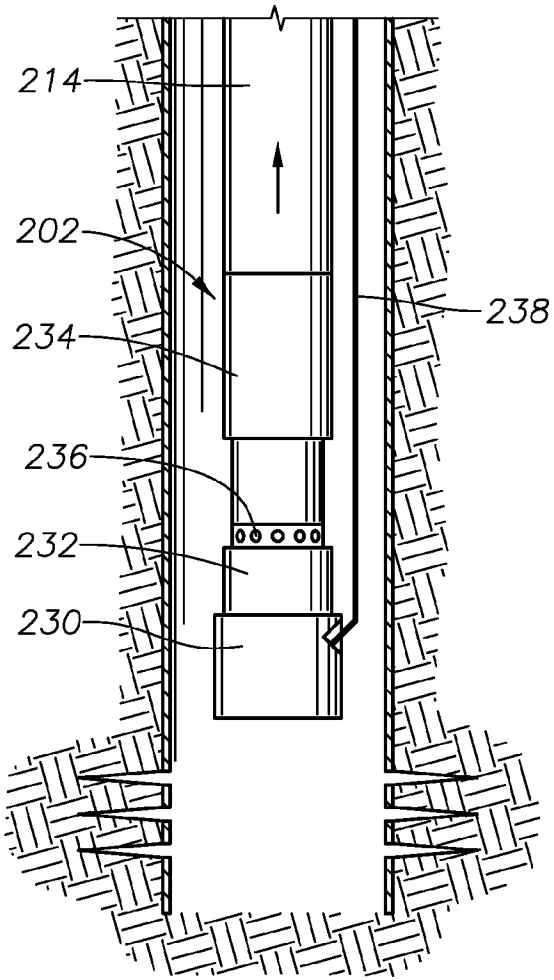
FIG. 3 is a diagrammatic side view of the electrical submersible pump in the well system shown of FIG. 2.

In that regard, FIG. 3 is a diagrammatic side view of the electrical submersible pump 202 in the well system 200 shown in FIG. 2. The ESP 202 includes a motor 230, an equalizer 232, a pump 234, and intakes 236 through which fluid is drawn into the pump. Power is provided by an electrical cable 238 that extends through the production tubing 214. As the ESP 202 pumps hydrocarbons through the well system, it expels heat into the production tubing 214. Specifically, various components of the ESP 202, such as the motor 230, pump 234, and electrical cable 238, generate thermal energy that is propagated through the well system. The amount of thermal energy released may depend on a number of factors such as ESP size, housing material, time period of operation, pump operational speed, power drawn through the electrical cable, motor size, and any number of additional and/or factors. In certain embodiments, the amount of thermal energy expelled by an ESP may be obtained from a manufacturer of the ESP or other source.

Figure 4:
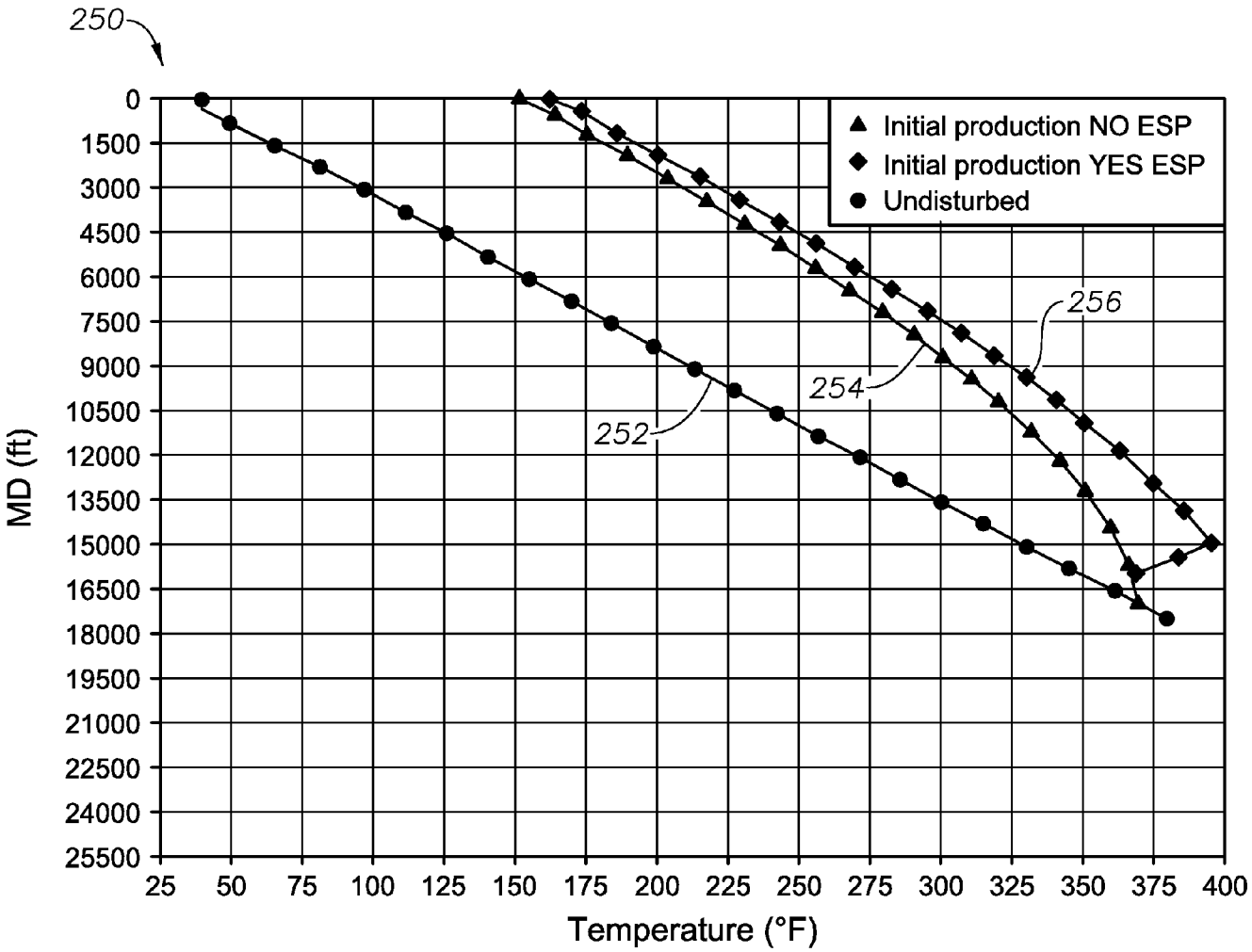
FIG. 4 illustrates is an example line graph depicting thermal simulations of two different well configurations over a long term production scenario of a year.

Referring now to FIG. 4, illustrated is an example line graph 250 depicting an undisturbed temperature line 252 and thermal simulation lines 254 and 256 of two different well configurations over a long term production scenario (e.g., a year). In this example, as shown by line 252, the temperature of a formation that is undisturbed by a well system increases linearly as distance from the surface increases. Thermal simulation line 254 depicts the temperature of fluid in a first well system at increasing distances below the surface. Thermal simulation line 256 depicts the temperature of fluid in a second well system similar to the first well system but having an ESP—such as ESP 202—disposed in the system. As mentioned above, in the non-limiting, illustrative example, ESP is disposed approximately 15,000 ft measured depth below RKB. As shown by the example line graph 250, the additional thermal energy expelled by the ESP in the second well system causes an increase in fluid temperature along the entire length of the well system as compared to the first well system. Specifically, at approximately 15,000 ft RKB measured depth below the tubing where the ESP is positioned, fluid in the second well system with the ESP is approximately 30 degrees warmer than the fluid in the first well system without an ESP. As the distance from the surface decreases, the presence of the ESP affects fluid temperatures by a decreasing amount. This difference in temperature of fluids along a well system caused by a heat source within the wellbore, such as an ESP, is sufficient to affect tubing and wellbore integrity along a substantial portion of the length of the tubing through increased pressures. The downhole simulator 110 of the invention is disposed to account for temperature and pressure changes due to heat sources disposed within a well system, thereby more accurately simulating downhole conditions during one or more phases of the life of the wellbore.

As a further example of the effect heat sources such an electrical submersible pump have on well systems, the table below illustrates the difference in movement of a 3½ diameter production tubing in a two well systems—one with an ESP and one without—over the course of a one year production scenario.

| | MD (ft) | | Hook's | Buckling | Balloon | Thermal | Total |
|---|---|---|---|---|---|---|---|
| | Top | Base | Law (ft) | (ft) | (ft) | (ft) | (ft) |
| Well System w/o ESP | 40.1 | 16,000 | 0.01 | 0.0 | −0.71 | 3.83 | 3.12 |
| Well System with ESP | 40.1 | 40.1 | 0.0 | 0.0 | −0.74 | 5.22 | 4.48 |

The above example table illustrates that, among other things, the additional thermal energy introduced into a well system by an ESP may cause a 3½ diameter production tubing to increase in length by as much as 1.5 feet (3.83 vs. 5.22) as compared to similar tubing in a well system without an ESP. This increase in length is substantial enough to cause tubing stress—and thus loss of integrity—in a locked tubing completion configuration.

The additional thermal energy and pressure in the various components of a well system due to the presence of an additional heat source such as an ESP ultimately affects the annular fluids within the plurality of strings disposed in the well system. Specifically, a difference in annular fluid expansion (AFE) between well systems with and without ESPs may be measured. For example, over the course of a one year production run, the presence of an ESP in a well system may increase the trapped annular pressure by over 500 psi in each of a 13⅜ inch intermediate annulus casing, a 9⅝ inch protective casing, and a 7 inch production tieback. Again, this increase in annular fluid expansion—and thus, trapped annular pressure—is sufficient to compromise well integrity and is therefore addressed by the downhole simulator 110 of the present disclosure through the inclusion of heat source information in downhole simulations. One of ordinary skill in the art would recognize that the above illustrations of the effects of additional heat sources in a well system are simply examples and different well systems may react differently to additional thermal energy. Further, although the additional heat source is described as an ESP certain embodiments of the invention, other embodiments of the invention may be disposed to address other types and numbers of heat sources disposed within well systems.

Figure 5:
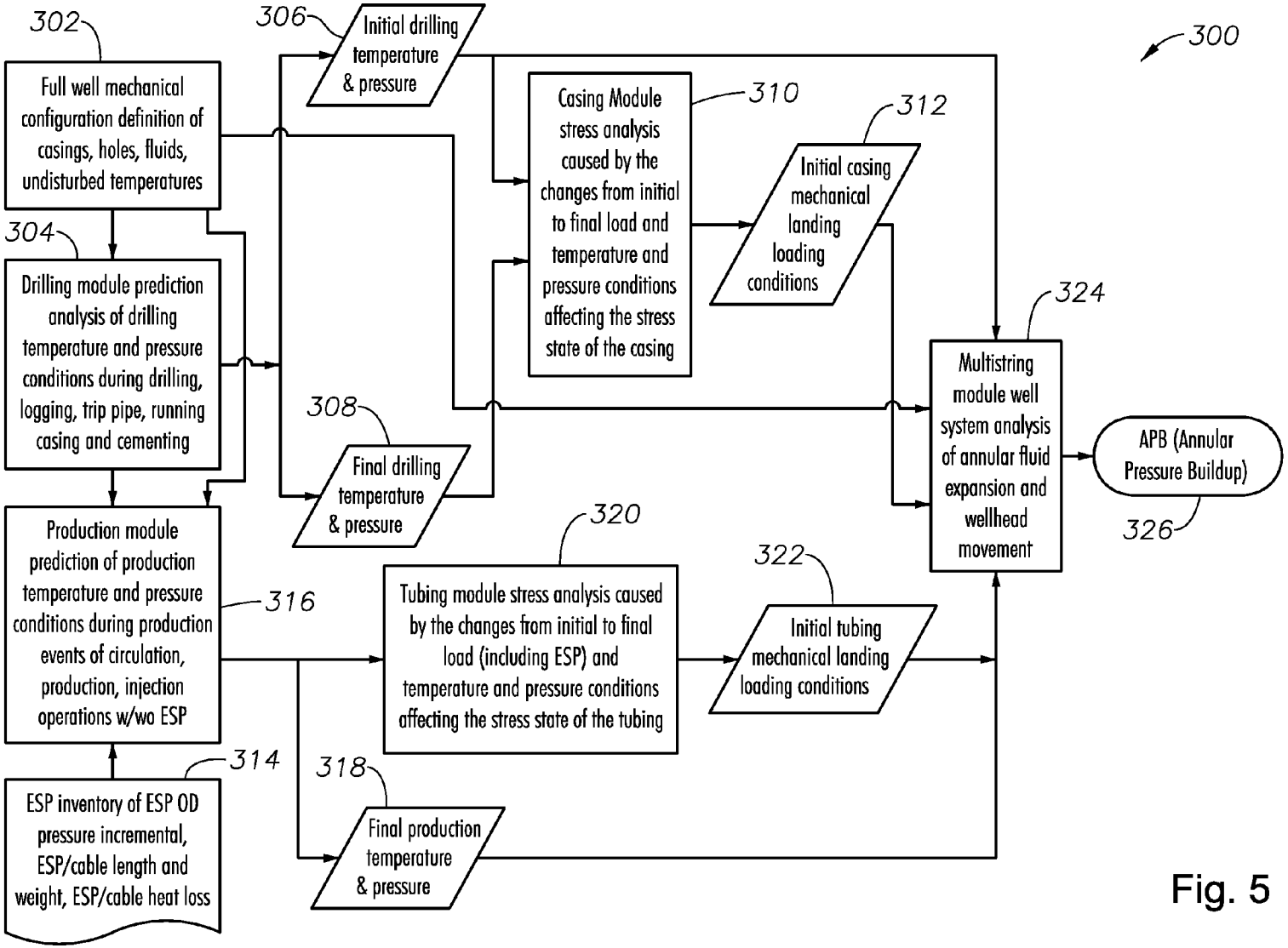
FIG. 5 illustrates a method of simulating downhole conditions in a well system according to aspects of the present disclosure.

Referring now to FIG. 5, illustrated is a method 300 of simulating downhole conditions in a well system according to aspects of the present disclosure. In one embodiment, the method 300 may be implemented by the downhole simulator 110 in the downhole simulation system 100 of FIG. 1. In particular, the method 300 in FIG. 5 illustrates an example data flow between the drilling prediction module 112, the production prediction module 114, the casing stress module 116, the tubing stress module 118, and the multi-string module 120 in the downhole simulator 110 according to a various aspects of the present invention.

At block 302, the mechanical configuration of the well is defined using manual or automated means. For example, a user may input well configuration information via I/O device 106 and display 108 in downhole simulation system 100. However, the configuration information may also be received via network communication module 105 or called from memory by processor 102. In this illustrated embodiment, the configuration information defines the well's physical and operational configuration such as, for example, number and type of casing and tubing strings (i.e., inventory), casing and hole dimensions, annular fluids surrounding the strings, cement types, undisturbed static downhole temperatures, operation duration, and environment variables such as geothermal properties of the formation and ocean currents. Based upon these input variables, at block 304, using drilling prediction module 112, processor 102 models the temperature and pressure conditions present during drilling, logging, trip pipe, casing, and cementing operations. At block 306, processor 102 then outputs the initial drilling temperature and pressure of the wellbore.

Next, at block 308, processor 102 outputs the "final" drilling temperature and pressure. Here, "final" may also refer to the current drilling temperature and pressure of the wellbore if the downhole simulator 110 is being utilized to analyze the wellbore conditions in real time. If this is the case, the "final" temperature and pressure will be the current temperature and pressure of the wellbore during that particular stage of downhole operation sought to be simulated. Moreover, the present invention could be utilized to model a certain stage of the drilling or other operation. If so, the selected operational stage would dictate the "final" temperature and pressure.

The method next moves to block 310, where the initial and final drilling temperature and pressure values are provided to the casing stress module 116, where processor 102 simulates the stresses on the casing strings caused by changes from the initial to final loads during drilling, as well as the temperature and pressure conditions affecting those casing strings. At block 312, processor 102 then outputs the initial casing mechanical landing loading conditions to the multi-string module 120. Referring back to step 302, the inputted well configuration information may also be provided directly to multi-string module 120. In addition, in certain embodiments, at block 306 the initial drilling temperature and pressure data may be provided directly to multi-string module 120.

Referring back to block 202, after processor 102 has modeled the drilling temperature and pressure conditions present during drilling, logging, trip pipe, casing, and cementing operations, the results of the simulation are provided to production prediction module 114. As part of this, the completion configuration information of the well system defined in block 302 is also entered into the production prediction module 114. That is, all components of the well system that will be present during production are incorporated by the production prediction module 114, including additional heat sources disposed in the well bore. In that regard, in block 314, heat source information is fed into the production prediction module 114 so that it may incorporate the information into thermal transfer simulations of downhole conditions during production scenarios. In certain embodiments, specific thermal expenditure information about a heat source may be directly entered into the downhole simulator 110 prior to a downhole simulation. For example, heat source information such as the amount of heat released over a defined time period may be directly entered into the production prediction module 114 for inclusion into a thermal transfer simulation of the well system. In other embodiments, more general heat source information such as heat source dimensions, location, and operational power requirements may be entered into the downhole simulator 110 and the simulator may subsequently calculate the amount of thermal energy expelled by the heat source. In certain embodiments, where an electrical submersible pump is disposed within the well system, heat source information fed into the production prediction module 114 may include ESP outside diameter, ESP length, ESP weight, ESP electrical cable length and thickness, ESP location within the well system, and/or heat loss of each component of the ESP (pump heat loss, motor heat loss, electrical cable heat loss).

After all well completion configuration information, including heat source information, has been fed into the production prediction module 114, method 300 moves to block 316 where the processor 102 simulates production temperature and pressure conditions in the wellbore of the well system during operations such as circulation, production, and injection operations. For instance, production prediction module 114 may simulate temperature transfer through the well system based on the configuration information and the additional heat source information. Then, at block 318, processor 102 determines the final production temperature and pressure based upon the analysis block 316, and this data and the simulated temperature transfer data is then fed into multi-string module 120.

Referring back to block 316, after the production temperature and pressure conditions have been modeled, the simulation results are provided to the tubing stress module 118. At block 320, processor 102 simulates the tubing stresses caused by changes from the initial to final temperatures and loads, as well as the temperature and pressure conditions affecting the stress state of the tubing. As described above, the tubing stress module 118 analyzes the load and movement of tubing within a well system, as well as tubing buckling and design integrity. As an aspect of this, the tubing stress simulation is affected by additional heat sources disposed in the well system, as defined by the heat source information. For example, additional heat transferred from an ESP into a production tubing string may cause the tubing string to expand and lose integrity beyond normal production conditions. At block 322, processor 102 outputs the initial tubing mechanical landing loading conditions, and this data is provided to the multi-string module 120. At block 324, after simulation data from the plurality of modules has been provided to the multi-string module 120, the final (or most current) total well system analysis and simulation is performed by processor 102 in order to estimate the annular fluid expansion (i.e., trapped annular pressures) and wellhead movement. For example, the annular fluid pressure simulation is based on the casing stress module simulation in block 310, the tubing stress module simulation in block 320 and the production simulation at block 316, which is based in part on the heat source information. The multi-string module 120 outputs simulation results that include annular fluid pressure buildup information 326.

One of ordinary skill in the art would understand that method 300 of simulating downhole conditions in a well system is simply an example embodiment, and in alternative embodiments, additional and/or different steps may be included in the method. For example, in certain embodiments, the production prediction module simulation in block 316 may predict thermal transfer within a well system based on heat source information describing a plurality of heat sources disposed within the system. For instance, multiple pumps of varying types may perform various functions at locations throughout a well system. The production prediction module may perform a comprehensive thermal transfer analysis that incorporates heat source information corresponding to the plurality heat sources throughout the well system.

Accordingly, various embodiments of the present invention may be utilized to conduct a total well system analysis during a design phase or in real-time during production operations. As an aspect of this, the influence of the thermal expansion of annulus fluids, and/or the influence of loads imparted on the wellhead during the life of the well, as well as the load effects on the integrity of a well's tubulars may be predicted. The described embodiments further determine the pressures due to the expansion of annular fluids and the position (e.g., displacement) of the wellhead during drilling operations. Accordingly, the load pressures and associated wellhead displacement values are used to determine the integrity of a defined set of well tubulars in the completed well or during drilling operations. As described above, these simulations incorporate heat source information describing additional heat sources disposed within a well system so that downhole conditions may be more accurately predicted.

The foregoing methods and systems described herein are particularly useful in creating and executing a plan to develop a reservoir including one or more well systems. First a reservoir is modeled with reservoir simulation systems and then downhole simulations system may be employed to design a well completion plan for one or more wells. In an embodiment, the drilling well completion plan includes the selection of various tubulars to be disposed in a proposed wellbore. The plan may include construction materials for components of proposed well systems including tubing and casing materials, sizes, and types. The downhole simulator may then be run to model well production and conditions over a period of time. As an aspect of this, the downhole simulations may be utilized to adjust one or more proposed features of the wellbore system. In certain embodiments, the well completion plan may be optimized by the previously-described downhole simulation method. For example, a downhole simulator may be employed to predict conditions that may occur in a wellbore so that parameters such as tubular sizing may be independently and separately optimized for a wellbore in the initial model of the reservoir. Based on the optimized model, a drilling plan may be implemented and a physical wellbore may be drilled and constructed in accordance with the plan.

In a further exemplary aspect, the present disclosure is directed to a method for drilling a wellbore in reservoir. The method includes utilizing a reservoir simulation system to model reservoir flow and develop a drilling plan and well system configurations using a downhole simulator, such as that described herein. Once reservoir flow has been modeled and optimized and wellbore conditions modeled and optimized, the method includes preparing equipment to construct a portion of a wellbore in accordance with the drilling plan, initiating drilling of the wellbore and thereafter, drilling and constructing a wellbore in accordance with the drilling plan.

While the downhole simulation system has been described in the context of subsurface modeling, it is intended that the simulator and system described herein can also model surface and subsurface coupled together. A non-limiting example of such a simulator is the modeling of temperature and pressure conditions in a surface network consisting of flowlines, pipelines, pumps, and equipment such as pumps, compressors, valves, etc coupled with the well and the reservoir together as an integrated flow network or system.

In one exemplary aspect, the present disclosure is directed to a method for simulating downhole conditions is described. The method includes receiving configuration information about a well system in a production configuration, the well system including annular fluids disposed therein and receiving heat source information associated with a heat source disposed within the well system. The method also includes simulating temperature transfer in the well system during a production scenario based at least on the configuration information and the heat source information and predicting pressure buildup in the annular fluids based on the simulated temperature transfer in the well system.

In another exemplary aspect, the present disclosure is directed to a computer-implemented method of simulating downhole conditions in a multi-string well system. The method includes receiving, with a production prediction module, a completion configuration definition of the multi-string well system, the completion configuration definition describing annular fluids within the strings of the multi-string well system and receiving, with the production prediction module, heat source information associated with a heat source disposed within the well system. The method also includes simulating, with the production prediction module, temperature transfer in the well system during a production scenario based at least on the completion configuration definition and the heat source information. The method also includes receiving, at a multi-string module, simulated temperature transfer data from the production prediction module and predicting, with the multi-string module, pressure buildup in the annular fluids within the strings of the multi-string well system based on the simulated temperature transfer data.

In yet another exemplary aspect, the present disclosure is directed to a computer-implemented downhole simulation system. The system includes a processor, a non-transitory storage medium accessible by the processor, and software instructions stored on the storage medium. The software instructions are executable by the processor for receiving configuration information about a well system in a production configuration, the well system including annular fluids disposed therein and receiving heat source information associated with a heat source disposed in the well system. The software instructions are also executable by the processor for simulating temperature transfer in the well system during a production scenario based at least on the configuration information and the heat source information and predicting pressure buildup in the annular fluids based on the simulated temperature transfer in the well system.

In a further another exemplary aspect, the present disclosure is directed to a method for drilling wellbores in a reservoir. The method includes receiving configuration information about a proposed well system in a production configuration, the proposed well system including annular fluids disposed therein and receiving heat source information associated with a heat source defined in the proposed well system. The method also includes simulating temperature transfer in the proposed well system during a production scenario based at least on the configuration information and the heat source information and predicting pressure buildup in the annular fluids based on the simulated temperature transfer in the proposed well system. Further, the method includes, selecting construction components for at least one physical wellbore corresponding to the proposed well system in the reservoir based on the predicted pressure buildup and preparing equipment to construct a portion of the at least one physical wellbore. Additionally, the method includes drilling and constructing the at least one physical wellbores in accordance with the selected construction components.

While certain features and embodiments of the disclosure have been described in detail herein, it will be readily understood that the disclosure encompasses all modifications and enhancements within the scope and spirit of the following claims. Furthermore, no limitations are intended in the details of construction or design herein shown, other than as described in the claims below. Moreover, those skilled in the art will appreciate that description of various components as being oriented vertically or horizontally are not intended as limitations, but are provided for the convenience of describing the disclosure.

It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A method of production from a reservoir, comprising:

receiving configuration information about a proposed well system in a production configuration, the well system including annular fluids disposed therein;

receiving heat source information associated with a heat source disposed within the well system;

simulating heat transfer in the well system during a production scenario based at least on the configuration information and the heat source information;

predicting pressure buildup in the annular fluids based on the simulated heat transfer in the well system; and adjusting a proposed feature of the well system based on the predicted pressure buildup caused by the simulated heat transfer.

2. The method of claim 1, wherein receiving heat source information includes receiving information about the amount of thermal energy output from the heat source.

3. The method of claim 1, wherein receiving heat source information includes receiving information about the physical configuration of the heat source.

4. The method of claim 3, wherein simulating heat transfer in the well system includes calculating the thermal energy output from the heat source based on the information about the physical configuration of the heat source.

5. The method of claim 1, wherein receiving heat source information includes receiving information describing the location of the heat source within the well system.

6. The method of claim 1, wherein receiving heat source information includes receiving information about an electrical submersible pump disposed within the well system.

7. The method of claim 6, wherein the information about the electrical submersible pump includes at least one of an outside diameter of the electrical submersible pump, a length of the electrical submersible pump, a weight of the electrical submersible pump, and a length of an electrical cable associated with the electrical submersible pump.

8. The method of claim 6, wherein the information about the electrical submersible pump includes information about the thermal energy output by the electrical submersible pump during operation.

9. The method of claim 8, wherein the information about the thermal energy is calculated by a manufacturer of the electrical submersible pump.

10. The method of claim 1, wherein the well system includes a wellhead; and wherein the predicting pressure buildup includes predicting wellhead movement.

11. The method of claim 1, further including simulating stress loads on tubing disposed within the well system based at least on the heat source information; and wherein the predicting pressure buildup in the annular fluids is based in part on the simulated stress loads on the tubing.

12. A computer-implemented method of simulating downhole conditions in a multi-string well system, comprising:

receiving, with a production prediction module, a completion configuration definition of the multi-string well system, the completion configuration definition describing annular fluids within the strings of the multi-string well system, said production prediction module forming at least a portion of a downhole simulation system having a processor and a non-transitory storage medium accessible by the processor, said production prediction module including software instructions stored on the storage medium executable by the processor;

receiving, with the production prediction module, heat source information associated with a heat source disposed within the well system;

simulating, with the production prediction module, heat transfer in the well system during a production scenario based at least on the completion configuration definition and the heat source information;

receiving, at a multi-string module, simulated heat transfer data from the production prediction module, said multi-string module forming at least a portion of said downhole simulation system;

predicting, with the multi-string module, pressure buildup in the annular fluids within the strings of the multi-string well system based on the simulated heat transfer data; and adjusting a feature of the well system based on the predicted pressure buildup caused by the simulated heat transfer.

13. The method of claim 12, further including simulating, with a tubing stress module, stress loads on tubing strings disposed in the multi-string well system based at least on the heat source information; and further including receiving, at the multi-string module, simulated tubing string stress load data from the tubing stress module;

wherein the predicting pressure buildup in the annular fluids within the strings of the multi-string well system is also based on the simulated tubing string stress load data.

14. The method of claim 12, wherein receiving heat source information includes receiving information about the amount of thermal energy output from the heat source.

15. The method of claim 12, wherein receiving heat source information includes receiving information about the physical configuration of the heat source.

16. The method of claim 15, wherein simulating heat transfer in the well system includes calculating the thermal energy output from the heat source based on the information about the physical configuration of the heat source.

17. The method of claim 12 wherein:

receiving heat source information includes receiving information about an electrical submersible pump disposed within the well system.

18. The method of claim 17 wherein:

the information about the electrical submersible pump includes information about the thermal energy output by the electrical submersible pump during operation.

19. The method of claim 17, wherein the information about the electrical submersible pump includes at least one of an outside diameter of the electrical submersible pump, a length of the electrical submersible pump, a weight of the electrical submersible pump, and a length of an electrical cable associated with the electrical submersible pump.

20. A computer-implemented downhole simulation system, the system comprising:

a processor;

a non-transitory storage medium accessible by the processor; and software instructions stored on the storage medium and executable by the processor for:

receiving configuration information about a well system in a production configuration, the well system including annular fluids disposed therein;

receiving thermal energy output information associated with a heat source disposed in the well system;

simulating heat transfer in the well system during a production scenario based at least on the configuration information and the thermal energy output information;

predicting pressure buildup in the annular fluids based on the simulated heat transfer in the well system; and adjusting a parameter of the well system based on the predicted pressure buildup caused by the simulated heat transfer.

21. The computer-implemented downhole simulation system of claim 20 wherein:

said software instructions are executable by the processor for receiving information about an electrical submersible pump disposed within the well system.

22. The computer-implemented downhole simulation system of claim 21 wherein:

the information about the electrical submersible pump includes information about the thermal energy output by the electrical submersible pump during operation.

23. The computer-implemented downhole simulation system of claim 21 wherein:

the information about the electrical submersible pump includes information about a physical configuration of the electrical submersible pump.

24. The computer-implemented downhole simulation system of claim 23 wherein:

the information about the electrical submersible pump includes at least one of an outside diameter of the electrical submersible pump, a length of the electrical submersible pump, a weight of the electrical submersible pump, a length of an electrical cable associated with the electrical submersible pump.

25. The computer-implemented downhole simulation system of claim 20, said software instructions are executable by the processor simulating stress loads on tubing disposed in the well system based at least on the thermal energy output information;

wherein the predicting pressure buildup in the annular fluids is based in part on the simulated stress loads on the tubing.

26. A method for drilling wellbores in a reservoir, the method comprising:

receiving configuration information about a proposed well system in a production configuration, the proposed well system including annular fluids disposed therein;

receiving heat source information associated with a heat source defined in the proposed well system;

simulating heat transfer in the proposed well system during a production scenario based at least on the configuration information and the heat source information;

predicting pressure buildup in the annular fluids based on the simulated heat transfer in the proposed well system;

based on the predicted pressure buildup, selecting construction components for at least one physical wellbore corresponding to the proposed well system in the reservoir;

preparing equipment to construct a portion of the at least one physical wellbore; and drilling and constructing the at least one physical wellbores in accordance with the selected construction components.

27. The method of claim 26, wherein receiving heat source information includes receiving information about an electrical submersible pump disposed within the proposed well system.

28. The method of claim 27, wherein the information about the electrical submersible pump includes at least one of information about a physical configuration of the electrical submersible pump and information about the thermal energy output by the electrical submersible pump during operation.

* * * * *